United States Patent [19]

Arnold

[11] Patent Number: 4,874,271

[45] Date of Patent: Oct. 17, 1989

[54] SELF-PROPELLED TRENCH SHORING MACHINE

[76] Inventor: Jimmie D. Arnold, P.O. Box 301, Monte Vista, Colo. 81144

[21] Appl. No.: 944,995

[22] Filed: Dec. 22, 1986

[51] Int. Cl.[4] ..... E02D 17/00

[52] U.S. Cl. ..... 405/283; 405/282; 405/272

[58] Field of Search ..... 405/283, 282, 281, 272, 405/273

[56] References Cited

U.S. PATENT DOCUMENTS

| | | | |
|---|---|---|---|
| 3,159,978 | 12/1964 | DeLillo | 405/282 |
| 3,541,799 | 11/1970 | Jost et al. | 405/283 |
| 3,820,345 | 6/1974 | Brecht | 405/283 |
| 4,002,035 | 1/1977 | Wright | 405/283 |
| 4,421,440 | 12/1983 | Scheepers | 405/282 |
| 4,521,137 | 6/1985 | Brecht | 405/282 X |

*Primary Examiner*—Dennis L. Taylor
*Attorney, Agent, or Firm*—Kyle W. Rost

[57] ABSTRACT

A main frame carries top and bottom shoring plates, with the top plates supported on pivoted brackets so that they can be tilted for leveling purposes. These brackets also can move transversely on vertically adjustable carrier bars to match the spacing between plates to the trench width. The shoring plates overlap each other when in raised position and are supported by cables connected to the bottom plates, which support the carrier bars. When the bottom plates are lowered, the top plates also can drop until the carrier bars strike a stop. Then the bottom plates continue to be lowered until striking a further stop. The main frame is supported on driven, independently steered wheels that can be shifted between various lateral spacings to keep weight away from the sides of a trench.

7 Claims, 5 Drawing Sheets

SELF-PROPELLED TRENCH SHORING MACHINE

BACKGROUND OF THE INVENTION

1. Field of the Invention

The invention generally relates to hydraulic and earth engineering and more specifically to shoring, bracing, or cave-in protection for foundations, especially trench shoring of the shield type.

2. Description of the Related Art

In the art of trench shoring, U.S. Pat. No. 3,159,978 to De Lillo discloses a sheathing system in which slat-like shields are telescoped to cover the walls of a trench at selectable depth. The shields are suspended from cross beams that are transverse to the trench and carry longitudinal bridging beams whose width can be adjusted on the cross beams. This shoring system is not mobile and requires a crane to lift its components from the trench.

U.S. Pat. No. 3,541,799 to Jost et al discloses a shoring system in which rails are placed on either side of a ditch, and a car rolls on the rails. The car supports bracing walls that are of endless design and are free to roll over the ditch walls as the car progresses. The car is pulled by a separate tractor, and this pulling, in turn, causes the bracing walls to roll over the ditch walls.

U.S. Pat. No. 3,820,345 to Brecht discloses a self-propelled shoring machine in which the rear wall is composed of pushing members that advence the machine in the trench by pushing against the fill dirt behind the machine. The pushing members also can compact the fill dirt when the side, shoring plates are hydraulically spread to hold the machine in a fixed location. A conveyor carries dirt from the front to the rear. It is proposed that this machine rides on wheels against the bottom of the trench, which can be impractical. This shoring machine must be installed and removed by separate means, such as a crane, and it is evident that the side plates cannot be easily raised or lowered to fit the requirements of each particular trench.

U.S. Pat. No. 4,002,035 to Wright discloses a mobile frame that can carry a plurality of vertically slidable shoring plates. The frame is mounted on tracks or wheels, and the sides of the frame and wheels can be separated to accommodate different width trenches. The shoring plates are separated by hydraulic cylinders.

U.S. Pat. No. 4,421,440 to Scheeplers discloses a shoring system in which several plates are located one above the other, and the system comtemplates a removal technique in which the lower plates is withdrawn toward the center of the trench and then raised.

U.S. Pat. No. 4,521,137 to Brecht discloses a moveable shoring system in which upper and lower sections of a framework move longitudinally so as to push the framework forward by pressure against the backfill.

It would be desirable to have a device for shoring trench walls and thereby improving the safety of personnel in the vocation of laying pipe and performing other installations in trenches, wherein such device is both safe and inexpensive so as to be widely available.

To achieve the foregoing and other objects and in accordance with the purpose of the present invention, as embodied and broadly described herein, the trench shoring machine of this invention may comprise the following.

SUMMARY OF THE INVENTION

Against the described background, it is therefore a general object of the invention to provide a safe and inexpensive machine for shoring trenches.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, a trench shoring machine provides a main frame having first and second spaced apart longitudinally extending side walls, and first and second spaced apart, transversely extending opposite end walls joining said side walls. First and second pairs of substantially vertical guide members are carried by the main frame with one member of each pair being near an opposite transverse side wall of the main frame and each pair being near an opposite one of the end walls of the main frame. First and second transversely extending carrier bars respectively engage the first and second pairs of vertical guide members for guided vertical travel with respect to the main frame. A first plurality of shoring plates includes a top plate and a lower plate. A pair of carrier brackets is connected to the top plate and each is supported from a different one of the carrier bars for movement along the length of the carrier bars with the top plate, transversely of the main frame, and for substantially vertical movement with the top plate and carrier bars with respect to the vertical guide members. An elongated member is joined to the lower plate for variably moving the lower plate between relatively upper and lower vertical positions with respect to the main frame, wherein the lower plate in the upper position supports the top plate in a relatively upper position, and the lower plate in the lower position permits the top plate to move to a relatively lower position. In addition, a mechanism drives the elongated member to selectively move the lower plate between the upper and lower positions.

The accompanying drawings, which are incorporated in and form a part of the specification illustrate preferred embodiments of the present invention, and together with the description, serve to explain the principles of the invention. In the drawings:

DESCRIPTION OF THE PREFERRED EMBODIMENT

The invention discloses a shoring machine that is self-propelled and that has steel plates that telescope to obtain the desired depth in a trench to maintain safety. The width between the steel plates across a trench is maintained with adjustable arms that lock in the open position to stabilize the trench walls. The shoring plates are operated from a main support frame that has wheel or track frames that can be moved out from the main frame to keep the weight of the machine away from the trench walls.

Figure 1:
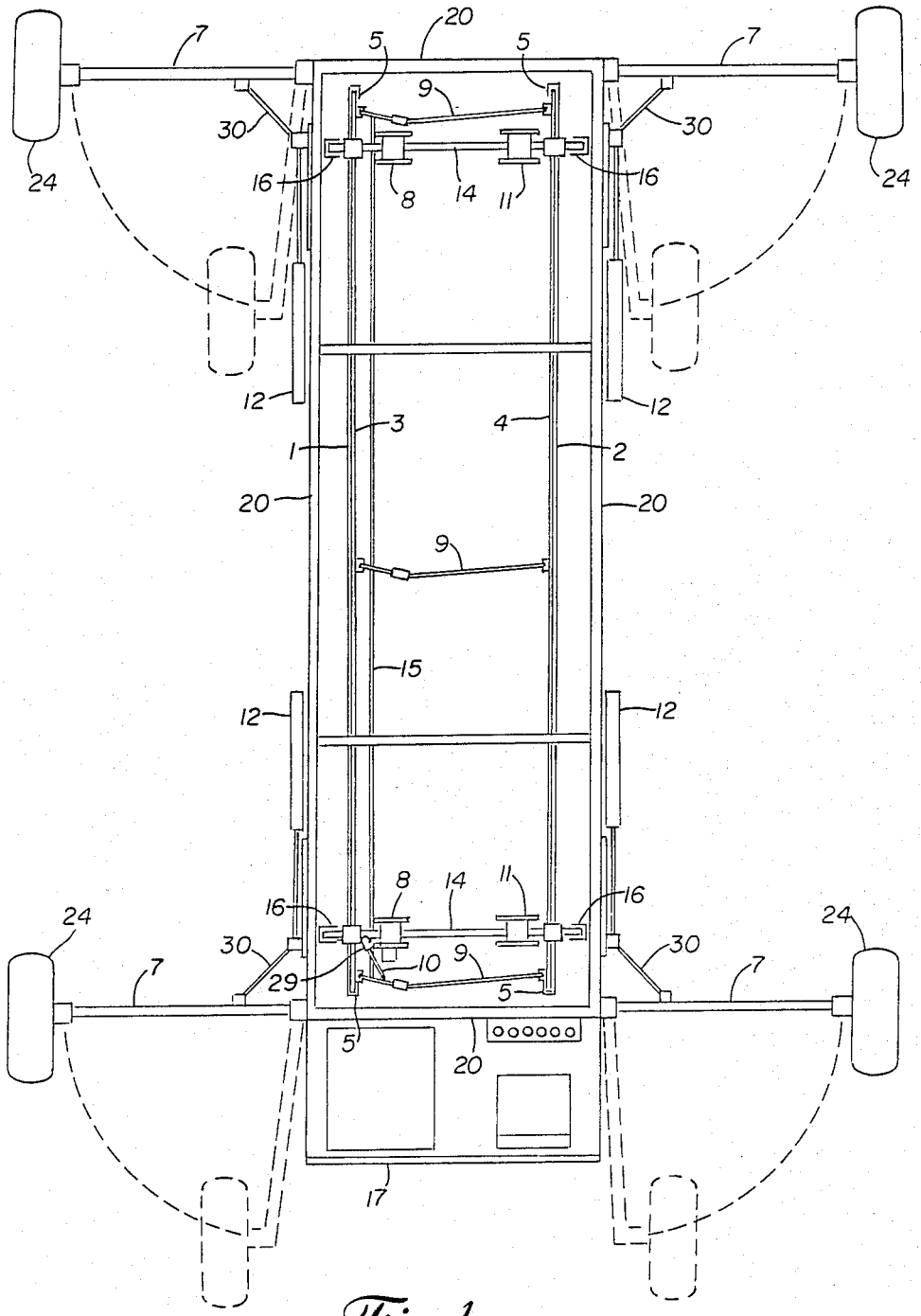
FIG. 1 is a top view of the trench shoring machine, showing the drive carrier frames in extended or open position, with the closed position being also shown in dashed lines.

With reference to FIG. 1, the trench shoring machine is shown to have a main frame 20 of generally rectangular design, having front and rear end walls as well as two spaced apart side walls. For convenience of description, the frame 20 may be considered to have an elongated, longitudinal dimension between the front and rear walls, and a transverse dimension between the side walls.

Figure 2:
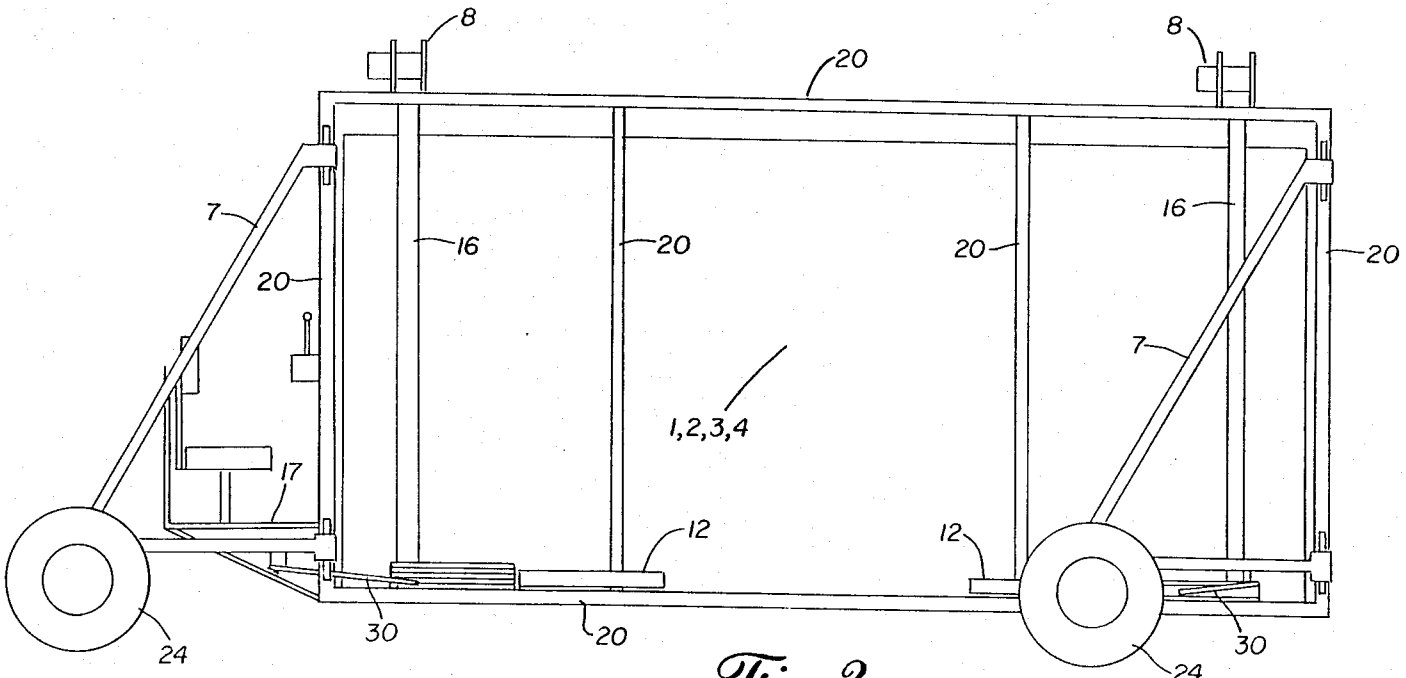
FIG. 2 is a side view thereof, showing the drive carrier frames in closed or transport position.
Figure 4:
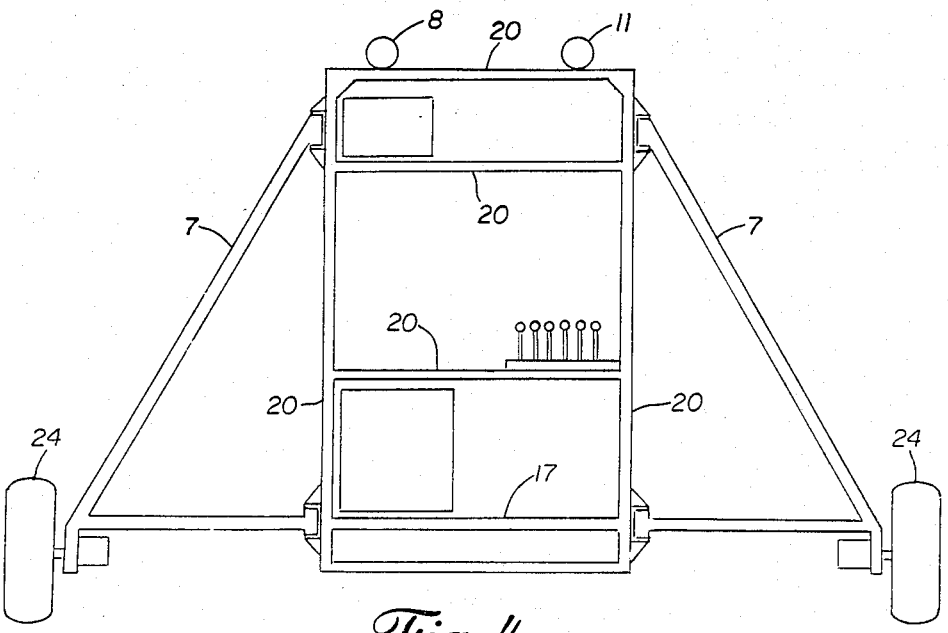
FIG. 4 is a rear view thereof.

At each of the four corners of this main frame 20 is an extendable drive carrier frame 7 supporting a drive mechanism 23 and wheel 24. FIG. 1 shows this frame in solid lines to be in open or extended position wherein the wheels are at a maximum spacing from the main frame 20 for supporting the machine with its weight far from the sides of the trench. In dashed lines, this figure shows the carrier frame 7 to be in closed or transport position, wherein the carrier frames 7 are folded to bring the wheels to a minimum width, close to the lateral position of the sides of the main frame 20. FIGS. 1, 2, and 4 show other details of the machine, including a platform for the motor and drive station 17 extending from the rear end of the main frame 20.

Figure 3:
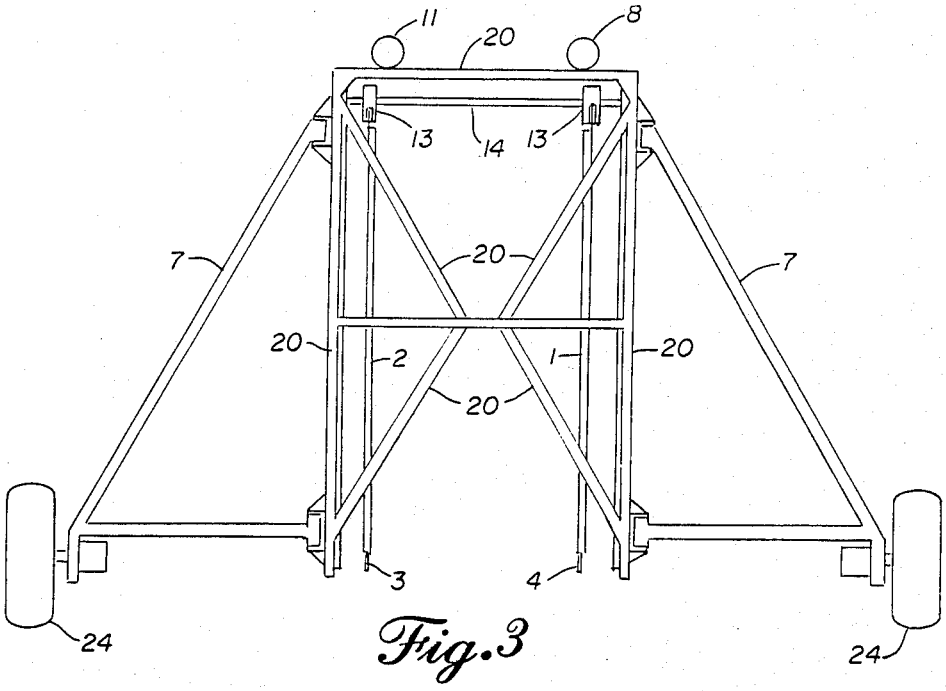
FIG. 3 is a front view thereof, showing the drive carrier frames in open position.

Hydraulic cylinders 12 are located near the side members of the main frame 20 and are connected between the main frame 20 and carrier frames 7 for the purpose of moving the carrier frames between closed and open positions. FIGS. 2, 3, and 4 show the carrier frames 7 to be generally triangular in vertical profile and to have the appearance of a right triangle. It is also shown in these figures that the carrier frames 7 have a pivoted connection to the main frame along a generally vertical axis. The cylinders 12 are connected to the carrier frame along its base leg, as viewed in FIG. 2, at a location offset from the pivoted axis to the main frame. A connecting bar 30 may extend between the cylinder 12 and carrier frame to cause the frame 7 to pivot in response to actuation of the cylinder.

Figure 7:
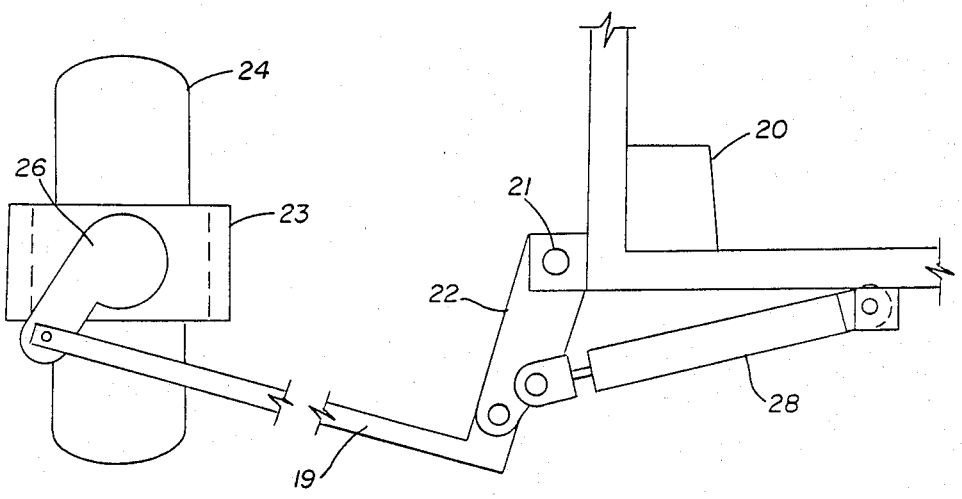
FIG. 7 is a fragmentary, enlarged, top view of the steering assembly.

With reference to FIG. 7, additional parts of the steering assembly are shown. The steering assembly functions to keep all four drive mechanisms 23 attached to the drive carrier frames 7 and to keep the wheels 24 in proper alignment with the main frame 20 at all stages of movement, from closed to full side extension away from the trench. In this detailed view, a steering arm 19 is shown to be pivoted to the main frame 20 at point 21 by an intermediate arm 22. The steering arm 19 also is joined to the drive mechanism 23 by an intermediate bar 26. An hydraulic steering cylinder 28 is connected to the arm 22 at an offset position from pivot point 21. Drive carrier frame 7, not shown in FIG. 7, maintains the drive mechanism 23 at a fixed position with respect to pivot point 21 and thereby permits the steering cylinder 28 to steer the wheel. Alternatively, when the steering cylinder 28 is in constant position but cylinder 12 is operated, the wheel will maintain its angle with respect to main frame 20 while being moved toward or away from the centerline of the main frame.

The main frame carries power driven mechanisms for raising and lowering the shoring plates between upper and lower positions with respect to the main frame. These mechanisms may be vertical lift winches 8, which in FIGS. 2, 3, and 4 are shown to be mounted on the main frame 20 near its top. The winches operate any suitable elongated members, such as steel cables, which are connected to shoring plates and can adjust the angle of the shoring plates with respect to the main frame. Thus, when the shoring machine is on a grade, the winches can be operated separately to cause the shoring plates to be level. One such winch 8 is carried on the main frame near each of the front and rear ends and may be located toward a common lateral side. Instead of using two winches on each side of the frame, it is preferred to use an idler roller 11 with each winch, on the opposite lateral side from the winch, and each winch may have a double cable. Two idler rollers 11 are located on the main frame 20, one near the opposite lateral side from each winch 8. Therefore, near each longitudinal end of the main frame are one powered winch and one idler roller.

Figure 6:
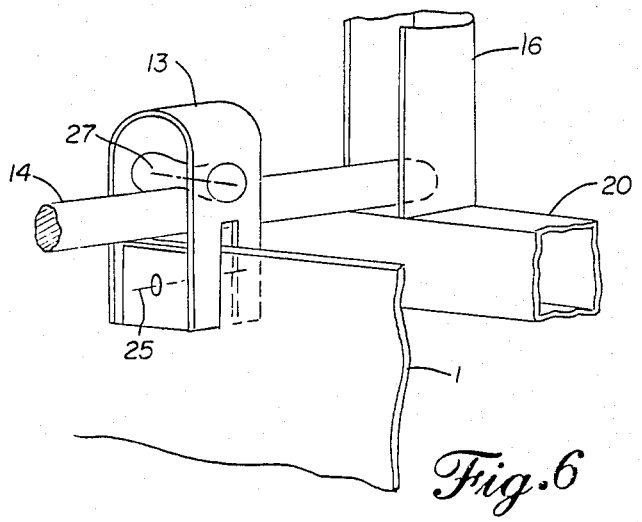
FIG. 6 is a fragmentary, enlarged, isometric view of a top plate carrier bracket and associated structures.

Below the winches and idler rollers are shown the shoring plates, with plates 1 and 3 being shown to the left side of FIG. 1, and plates 2 and 4 being shown to the right side of FIG. 1. The number of plates is not limited to those shown. With reference to FIG. 6, it can be seen that the top plates, such as plate 1, are supported from a transverse carrier bar 14 by a yolk shaped carrier bracket 13, which rests on the carrier bar 14 by a roller 27 in the bracket. Thus, the bracket 13 permits the top plates to be moved with respect to the bar 14, laterally of the main frame. In addition, each bracket 13 is attached to the top plate on a transverse pivoted junction 25. Thus, the plates can pivot with respect to each carrier bracket 13, which pivoting is controlled by the winches.

The top plates are held in transversely spaced apart position by hinged bracing arms 9, which are shown in FIG. 1 to be in a locked position. A push rod 15 interconnects the bracing arms 9 on the top plates so as to cause all of these arms to move together at their hinged junctions between locked and unlocked or released positions. An hydraulic cylinder 29 controls the movement of the push rod associated with the top plates.

The two top plate carrier bars 14 extend laterally of the main frame, with one such bar 14 being located approximately below a winch 8 and its associated idler roller 11 at each longitudinal end of the main frame 20. Four vertically guide members such as vertically extending carrier bar channels 16 are carried by the main frame 20, one near each corner. The channels open toward the centerline of the frame. The lateral ends of the carrier bars each are contained within the open slot of a carrier bar channel 16 and are guided by the channel slots during vertical movement with respect to the main frame. In FIGS. 2 and 3, wherein the shoring plates are in raised position, the carrier bars 14 are at the top of the carrier bar channels 16.

Figure 5:
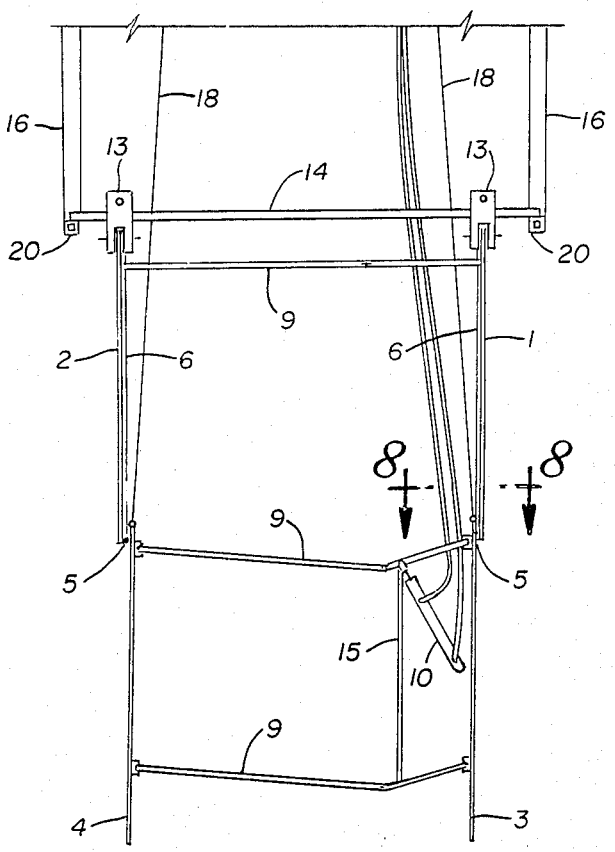
FIG. 5 is a fragmentary end view of the machine, showing the shoring plates in lowered position.
Figure 8:
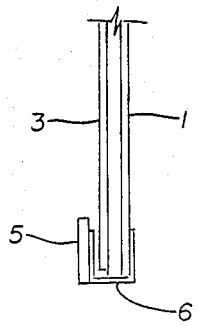
FIG. 8 is a cross-sectional view taken along the plane of line 8—8 of FIG. 5.

The operation of the shoring machine is shown in FIG. 5, wherein the shoring plates 1, 2, 3, and 4 are in extended, lowered position, as in a trench. The carrier bars 14 also are in lowered positions with respect to carrier bar channels 16 and are resting on a stop, in this case the frame members at the base of the side walls of the main frame 20. The top plates 1 and 2 are lowered position, with the top carrier plate brackets 13 resting on the carrier bar 14, thus supporting the top plates 1 and 2 in suspended position and allowing lower plates 3 and 4 to telescope further into the trench, until reaching the bottom edges of the top plates. The plate stops 5, best shown in FIG. 5, prevent the top edges of the lower plates from dropping below the bottom edges of the top plates. As shown in FIG. 8, the lower plates 3 and 4 are prevented from becoming laterally misaligned with the upper plates by guide channels 6, which may be carried on the vertical edges of the top plates.

Also shown in FIG. 5 are the double winch cables 18 extending from the winches 8. The cables extend to and are connected to the lower plates 3 or 4 on each side of the trench. Operation of the winches thereby raises or lowers the lower plates. However, when the lower plates are raised, they will strike bar 14 and cause it to be raised, also. Bar 14, in turn, will raise the top plates via the connection to brackets 13. Similarly, lowering the lower plates will first result in lowering bar 14 together with both top and bottom plates. When bar 14 rests against its stop on the base of frame 20, the lower plates can continue to be lowered independently of the top plates.

FIG. 5 also shows upper and lower bracing arms 9 connected to the bottom plates and actuated via a hydraulic cylinder 10. This cylinder acts through a second bracing arm push rod 15 to lock and unlock the bracing arms 9.

From the description, it can be seen that the telescoping shoring plates can extend to a desired depth from their own self-propelled frame. The use of two independently operated winches, one at each longitudinal end of the machine, allows the shoring plates to be leveled when the machine is on an incline. The carrier bars, which are moved within guide channels and come to rest on the top of the bottom beam of the main frame, keep the top of the two top plates above ground level. The top plate carrier brackets allow the plates to move sideways for conforming to the width of the trench and permit tilting to adjust the plates to the required angle for the grade of the machine. While the plates are held against the trench walls by the bracing arms, these arms can be partially released by hydraulic controls when necessary. The guide brackets on the top plates and any lower plates serve to stabilize the alignment of the plates, and the stops of the upper plates prevent the following plates from disengaging their guide channels.

The extendable drive carrier frames allow the drive wheels or track to be moved away from the walls of the open trench. A hydraulically operated mechanism moves the machine drive carrier frames away from the main frame to an extended position and into a closed position next to the main frame. The front and rear wheels are independently steered for allowing proper alignment with the open trench.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

The embodiments of the invention in which an exclusive property or privilege is claimed are defined as follows:

1. A trench shoring machine, comprising:

a main frame having first and second spaced apart longitudinally extending side walls, and first and second spaced apart, transversely extending opposite end walls joining said side walls;

first and second pairs of substantially vertical guide members carried by said main frame with one member of each pair being near an opposite transverse side wall of the main frame and each pair of guide members being near an opposite one of the end walls of the main frame;

first and second transversely extending carrier bars respectively engaging said first and second pairs of vertical guide members for guided vertical travel with respect to the main frame;

a first plurality of shoring plates including a top plate and a lower plate;

a pair of carrier brackets connected to said top plate and each supported from a different one of said carrier bars for movement along the length of the carrier bars with the top plate, transversely of the main frame, and for substantially vertical movement with the top plate and carrier bars with respect to the vertical guide members;

an elongated member joined to said lower plate for selectively moving the lower plate between relatively upper and lower vertical positions with respect to the main frame, wherein the lower plate in said upper position supports the top plate in a relatively upper position, and the lower plate in said lower position permits the top plate to move to a relatively lower position; and means for moving said elongated member to selectively move the lower plate between the upper and lower positions.

2. The trench shoring machine of claim 1, wherein said means for moving the elongated member comprises a first winch carried by the main frame; and the elongated member comprises a first cable connected to the winch.

3. The trench shoring machine of claim 2, further comprising a second winch having a second cable, wherein the first cable is connected to the lower shoring plate near the first end wall of the main frame, and the second cable is connected to the lower shoring plate near the second end wall of the main frame, permitting the first and second winches to independently lower each end of the lower shoring plate.

4. The trench shoring machine of claim 3, further comprising a first stop limiting the downward travel of the top shoring plate with respect to the main frame; and a second stop limiting the downward travel of the lower shoring plate with respect to the top shoring plate.

5. The trench shoring machine of claim 4, wherein said first and second carrier brackets each are connected to the top shoring plate by a pivoted junction having a transverse pivot axis, permitting the carrier brackets and top shoring plate to relatively pivot and allowing the top shoring plate to be positioned with the carrier brackets at different relative vertical heights.

6. The trench shoring machine of claim 1, wherein said first plurality of shoring plates is located near said first transverse side wall of the main frame, and further comprising:

a second plurality of shoring plates located near said second transverse side wall of the main frame and transversely spaced from the first plurality of shoring plates;

a bracing arm connecting and spacing apart a shoring plate of said first plurality from a shoring plate of said second plurality, wherein the bracing bar includes a hinged central joint having a locked position and a released position; and a means for moving the hinge of the bracing arm between locked and released positions.

7. The trench shoring machine of claim 1, further comprising:

a plurality of drive mechanisms, each having an associated power driven wheel;

a like plurality of drive carrier frames, each carrying a one of said drive mechanisms, having a hinged junction to said main frame and moveable on the hinged junction to shift the drive mechanisms between laterally more and less separated positions;

a means for steering each of said wheels; and a means for selectively moving said drive carrier frames on said hinged junction for adjusting the relative lateral spacing between the wheels.

* * * * *